US008911243B2

(12) United States Patent
Akama et al.

(10) Patent No.: US 8,911,243 B2
(45) Date of Patent: Dec. 16, 2014

(54) CONNECTION MEMBER, SOCKET MODULE, SOCKET AND METHOD FOR MANUFACTURING CONNECTION MEMBER

(71) Applicants: Fujitsu Component Limited, Shinagawa-ku, Tokyo (JP); Fujitsu Limited, Kawasaki-shi, Kanagawa (JP)

(72) Inventors: Junichi Akama, Tokyo (JP); Toshihiro Kusagaya, Tokyo (JP); Manabu Shimizu, Tokyo (JP); Akira Tamura, Kawasaki (JP); Yoshihiro Morita, Kawasaki (JP); Yasushi Masuda, Kawasaki (JP)

(73) Assignees: Fujitsu Component Limited, Tokyo (JP); Fujitsu Limited, Kawasaki (JP)

( * ) Notice: Subject to any disclaimer, the term of this patent is extended or adjusted under 35 U.S.C. 154(b) by 162 days.

(21) Appl. No.: 13/644,165

(22) Filed: Oct. 3, 2012

(65) Prior Publication Data

US 2013/0090021 A1 Apr. 11, 2013

(30) Foreign Application Priority Data

Oct. 5, 2011 (JP) ..... 2011-221325

(51) Int. Cl.

| | |
|---|---|
| ***H01R 12/10*** | (2006.01) |
| ***H01R 12/70*** | (2011.01) |
| ***H01R 12/73*** | (2011.01) |
| ***H01R 13/24*** | (2006.01) |

(52) U.S. Cl.

CPC ..... *H01R 12/7082* (2013.01); *H01R 12/73* (2013.01); *H01R 13/2428* (2013.01)

USPC ..... 439/66

(58) Field of Classification Search

CPC .. H01R 23/722; H01R 9/096; H01R 13/2435; H01R 13/2414

USPC ..... 439/66, 70, 71, 660, 717

See application file for complete search history.

(56) References Cited

U.S. PATENT DOCUMENTS 5,380,210 A * 1/1995 Grabbe et al. ..... 439/66
5,562,462 A * 10/1996 Matsuba et al. ..... 439/70

(Continued)

FOREIGN PATENT DOCUMENTS

JP 2001-297812 10/2001
JP 2004-336062 11/2004

OTHER PUBLICATIONS

Patent Abstracts of Japan, Publication No. 2001-297812, Published Oct. 26, 2001.

(Continued)

*Primary Examiner* — Amy Cohen Johnson
*Assistant Examiner* — Vladimir Imas
(74) *Attorney, Agent, or Firm* — Staas & Halsey LLP

(57) ABSTRACT

A connection member to be inserted into a through-hole of a socket module that is electrically connected between an electronic component and a substrate, the connection member includes: a first end portion that is connected to the electronic component; a second end portion that is connected to the substrate; a plurality of upper flexure portions that correspond to projections of a waveform arranged near the electronic component; and a plurality of lower flexure portions that correspond to projections of the waveform arranged near the substrate; wherein the connection member is a single conductor member with elasticity and is formed in the shape of the waveform.

20 Claims, 10 Drawing Sheets

(56) References Cited

U.S. PATENT DOCUMENTS

| | | | | |
|---|---|---|---|---|
| 5,980,335 | A * | 11/1999 | Barbieri et al. | 439/824 |
| 6,062,873 | A * | 5/2000 | Kato | 439/71 |
| 6,102,711 | A * | 8/2000 | Hanada et al. | 439/70 |
| 6,341,970 | B1 * | 1/2002 | Ho et al. | 439/266 |
| 6,402,567 | B1 * | 6/2002 | Zhu | 439/700 |
| 6,416,331 | B1 * | 7/2002 | Shimizu | 439/66 |
| 6,419,500 | B1 * | 7/2002 | Kister | 439/66 |
| 6,524,115 | B1 * | 2/2003 | Gates et al. | 439/66 |
| 6,527,597 | B1 | 3/2003 | Harper, Jr. | |
| 6,534,856 | B1 * | 3/2003 | Dozier et al. | 257/698 |
| 6,758,682 | B1 * | 7/2004 | Kosmala | 439/66 |
| 6,759,741 | B2 * | 7/2004 | Kline | 257/727 |
| 6,790,057 | B2 * | 9/2004 | DelPrete et al. | 439/91 |
| 6,898,087 | B1 * | 5/2005 | Chen | 361/804 |
| 6,902,410 | B2 * | 6/2005 | Watanabe | 439/66 |
| 6,909,056 | B2 * | 6/2005 | Vinther | 174/260 |
| 6,966,783 | B2 * | 11/2005 | Hachuda et al. | 439/66 |
| 7,381,061 | B2 * | 6/2008 | Hung et al. | 439/66 |
| 7,383,632 | B2 * | 6/2008 | Dittmann | 29/884 |
| 7,384,271 | B1 * | 6/2008 | Mickievicz | 439/66 |
| 7,458,818 | B2 * | 12/2008 | Kiyofuji et al. | 439/66 |
| 7,479,015 | B2 * | 1/2009 | Ruttan et al. | 439/66 |
| 7,517,226 | B2 * | 4/2009 | Kawam et al. | 439/66 |
| 7,517,256 | B2 * | 4/2009 | Chang | 439/701 |
| 7,645,147 | B2 * | 1/2010 | Dittmann | 439/82 |
| 7,649,368 | B2 * | 1/2010 | Eldridge et al. | 324/754.18 |
| 7,726,976 | B2 * | 6/2010 | Mason et al. | 439/66 |
| 7,731,504 | B2 * | 6/2010 | Kariya et al. | 439/66 |
| 7,740,488 | B2 * | 6/2010 | Taylor | 439/66 |
| 8,147,253 | B2 * | 4/2012 | Goodman et al. | 439/66 |
| 8,221,133 | B2 * | 7/2012 | Lin et al. | 439/66 |
| 8,360,789 | B2 * | 1/2013 | Yin et al. | 439/66 |
| 8,441,275 | B1 * | 5/2013 | Alladio | 324/756.02 |
| 8,547,699 | B1 * | 10/2013 | McCleary | 361/721 |
| 8,622,752 | B2 * | 1/2014 | Parrish et al. | 439/66 |
| 2002/0133941 | A1 * | 9/2002 | Akram et al. | 29/837 |
| 2005/0094490 | A1 * | 5/2005 | Thomenius et al. | 367/155 |
| 2005/0208788 | A1 * | 9/2005 | Dittmann | 439/66 |

OTHER PUBLICATIONS

Patent Abstracts of Japan, Publication No. 2004-336062, Published Nov. 25, 2004.

* cited by examiner

CONNECTION MEMBER, SOCKET MODULE, SOCKET AND METHOD FOR MANUFACTURING CONNECTION MEMBER

CROSS-REFERENCE TO RELATED APPLICATION

This application is based upon and claims the benefit of priority of the prior Japanese Patent Application No. 2011-221325, filed on Oct. 5, 2011, the entire contents of which are incorporated herein by reference.

FIELD

A certain aspect of the embodiments discussed herein is related to a connection member, a socket module, a socket and a method for manufacturing a connection member.

BACKGROUND

Conventionally, there has been known an electrical connector (i.e., a socket) that includes a plurality of modules and is placed on a substrate (see Japanese Laid-Open Patent Publication No. 2001-297812). Each module has a plurality of contact shoes arranged in the shape of lines. For example, a single electrical connector is formed by combining adjacent four modules.

Further, there has been conventionally known a technique in which a CPU (Central Processing Unit) and an ASIC (Application Specific Integrated Circuit) package are mounted on a socket on a substrate.

Further, there has been conventionally known a C-shaped contact as a contact for signal transmission.

SUMMARY

According to an aspect of the present invention, there is provided a connection member to be inserted into a through-hole of a socket module that is electrically connected between an electronic component and a substrate, the connection member including: a first end portion that is connected to the electronic component; a second end portion that is connected to the substrate; a plurality of upper flexure portions that correspond to projections of a waveform arranged near the electronic component; and a plurality of lower flexure portions that correspond to projections of the waveform arranged near the substrate; wherein the connection member is a single conductor member with elasticity and is formed in the shape of the waveform.

The objects and advantages of the invention will be realized and attained by the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

A description will now be given of exemplary embodiments with reference to the accompanying drawings.

Figure 1:
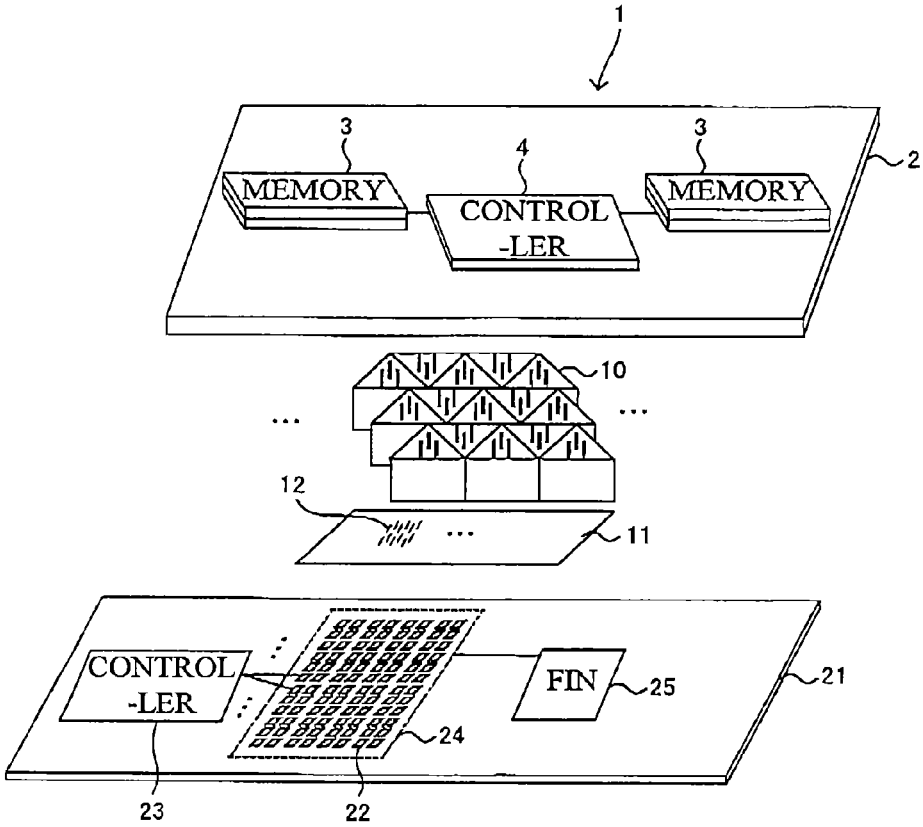
FIG. 1 is a diagram illustrating an arrangement relationship between a substrate, socket modules and an electronic component.
Figure 2:
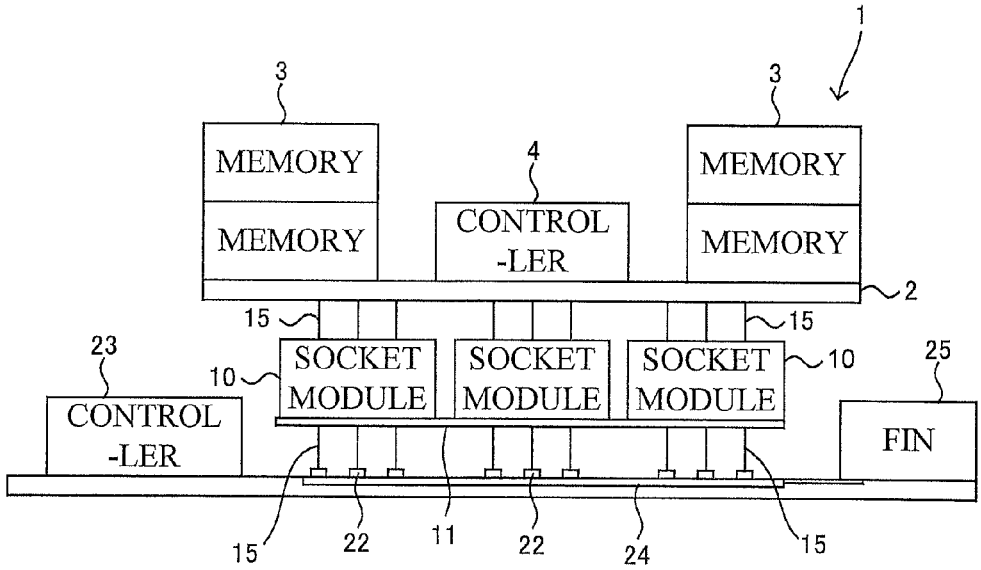
FIG. 2 is a cross-section diagram of the substrate, the socket modules and the electronic component when the socket modules and the electronic component are mounted on the substrate.

FIG. 1 is a diagram illustrating an arrangement relationship between a substrate, socket modules and an electronic component. FIG. 2 is a cross-section diagram of the substrate, the socket modules and the electronic component when the socket modules and the electronic component are mounted on the substrate.

In FIG. 1, a TSV (Through-Silicon Via) package 1 as the electronic component is mounted on a substrate 21 via a plurality of socket modules 10 and a sheet 11. A single socket is composed of the plurality of socket modules 10.

The TSV package 1 stores a plurality of laminated memories 3 and a controller 4 in a case (package) 2, for example. The memories 3 are connected to the controller 4. The controller 4 reads and write data from/in the memories 3, and communicates with a controller 23 in a substrate 21 via the socket modules 10 and the sheet 11.

Each of the socket modules 10 has the shape of a triangular prism, and has three contacts up and down, for example (see reference number 15 in FIG. 2). The upper three contacts of each socket module 10 come in contact with the case 2 of the TSV package 1. The lower three contacts of each socket module 10 come in contact with the substrate 21.

The sheet 11 is a flexible insulator and is made of Polyethylene Terephthalate (PET), for example. A plurality of through-holes 12 are formed on the sheet 11 so that the three contacts (i.e., lower three contacts) provided on a lower part of each socket module 10 come in contact with the substrate 21.

The substrate 21 is a rigid substrate such as a glass epoxy substrate. The substrate 21 includes: electrode patterns 22 with which the three contacts provided on the lower part of each socket module 10 come in contact; the controller 23 that is connected to the electrode patterns 22 and communicates with the TSV package 1; a heat dissipation pad 24 that comes in contact with the electrode patterns 22; and a fin 25 that is connected to the heat dissipation pad 24. The electrode patterns 22 are connected to the controller 23 or a ground.

The substrate 21 and the case 2 of the TSV package 1 have warpage of a micro level (e.g. 0.1 mm warpage). However, for the convenience of explanation, the warpage is not illustrated in FIGS. 1 and 2.

A signal from the controller 4 of the TSV package 1 flows into the controller 23 of the substrate 21 via the socket modules 10. Similarly, a signal from the controller 23 of the substrate 21 flows into the controller 4 of the TSV package 1 via the socket modules 10. Heat which occurs in the TSV package 1 is conducted to the fin 25 via the three contacts of each socket module 10, and the electrode patterns 22 and the heat dissipation pad 24 on the substrate 21, and is cooled with the fin 25. That is, each socket module 10 functions as a transmission path of the signals and the heat.

Figure 3A:
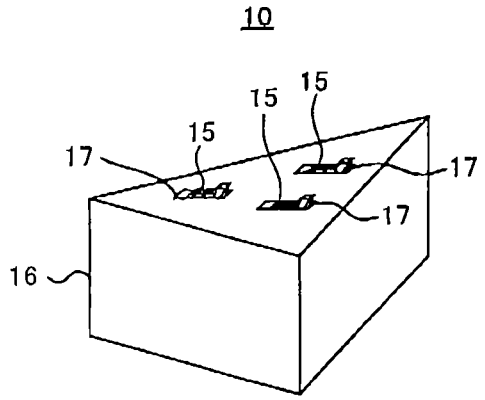
FIG. 3A is a diagram illustrating the schematic configuration of the socket module.
Figure 3B:
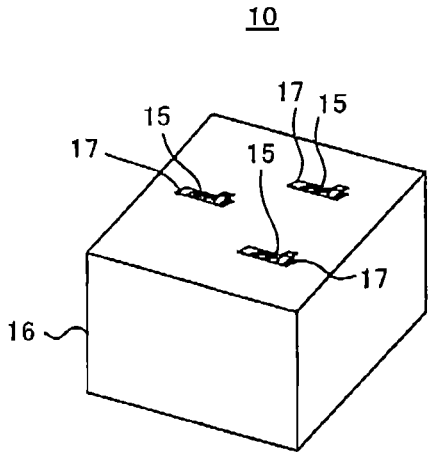
FIG. 3B is a diagram illustrating a first variation example of the schematic configuration of the socket module.
Figure 3C:
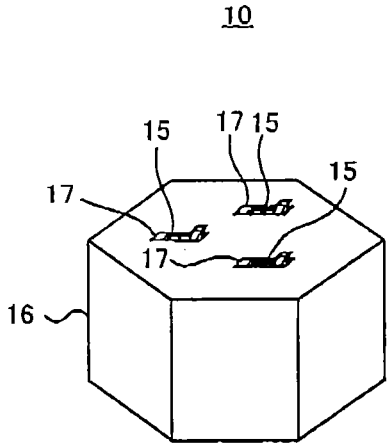
FIG. 3C is a diagram illustrating a second variation example of the schematic configuration of the socket module.
Figure 4A:
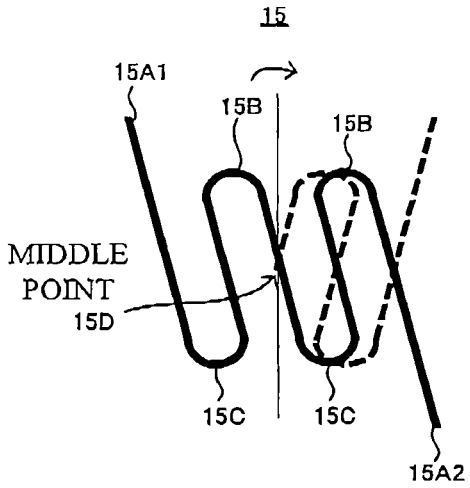
FIG. 4A is a diagram illustrating the configuration of a connection member built into the socket module.
Figure 4B:
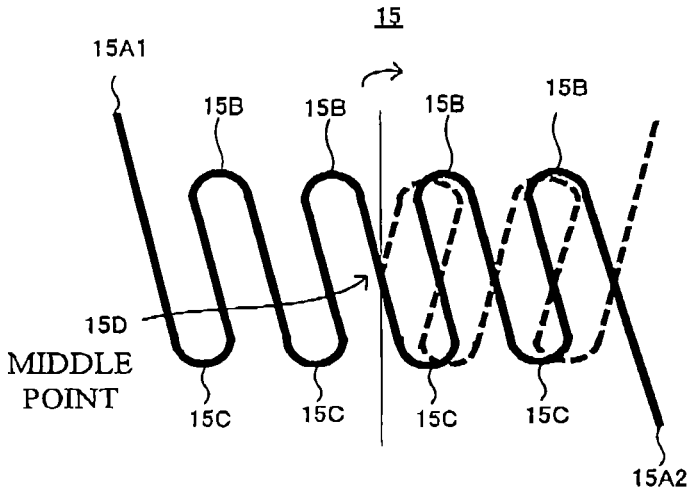
FIG. 4B is a diagram illustrating a first variation example of the configuration of the connection member.
Figure 4C:
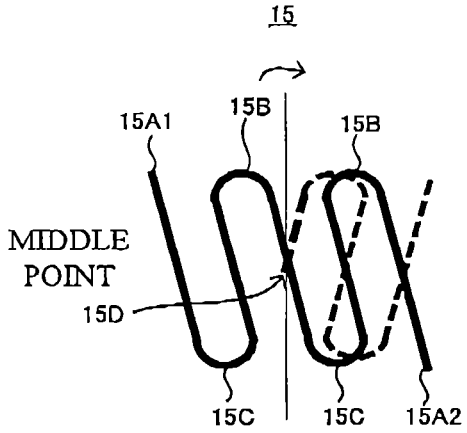
FIG. 4C is a diagram illustrating a second variation example of the configuration of the connection member.

FIG. 3A is a diagram illustrating the schematic configuration of the socket module 10. FIG. 3B is a diagram illustrating a first variation example of the schematic configuration of the socket module 10. FIG. 3C is a diagram illustrating a second variation example of the schematic configuration of the socket module 10. FIG. 4A is a diagram illustrating the configuration of a connection member 15 built into the socket module 10. FIG. 4B is a diagram illustrating a first variation example of the configuration of the connection member 15. FIG. 4C is a diagram illustrating a second variation example of the configuration of the connection member 15.

Each socket module 10 includes three connection members 15 that pass the signal from the TSV package 1 or the substrate 21, and a body unit 16 that has the shape of the triangular prism. Three through-holes 17 are formed in the body unit 16, and the connection member 15 is inserted into each of the through-holes 17. Although in the present embodiment, the form of the socket module 10 is the triangular prism, the form of the socket module 10 may be a polygonal pillar, such as a rectangular parallelepiped illustrated in FIG. 3B or a hexagonal prism illustrated in FIG. 3C.

The connection member 15 is composed of a conductor member with elasticity, e.g. a copper alloy. The body unit 16 is composed of an insulator and resin, such as polyethylene or polypropylene. The connection member 15 is formed in the shape of a waveform, as illustrated in FIG. 4A. The connection member 15 includes: an end portion 15A1 (a first end portion) that is connected to the case 2 of the TSV package 1; an end portion 15A2 (a second end portion) that is connected to the substrate 21; a plurality of upper flexure portions 15B that correspond to upper ends of the waveform (i.e., projections arranged near the TSV package 1); and a plurality of lower flexure portions 15C that correspond to lower ends of the waveform (i.e., projections arranged near the substrate 21). The shape of the waveform is a curved shape in which concavity and convexity continue, i.e., the shape of a sea swell. Conductor portions extending from the end portion 15A1 and the upper flexure portions 15B arranged at an upper side of the socket module 10 to the end portion 15A2 and the lower flexure portions 15C arranged at a lower side of the socket module 10 are parallel to each other. The conductor portions are portions of the linear connection member 15 other than the end portions 15A1 and 15A2, the upper flexure portions 15B and the lower flexure portions 15C.

The connection member 15 is twisted at a middle point 15D. The connection member 15 is bent at the middle point 15D so that the left half of the connection member 15 is opposed to the right half of the connection member 15. After the left half of the connection member 15 is twisted, it is arranged at the position of a dashed line of FIG. 4A. The end portion 15A1 projects from the through-hole 17 on an upper surface of the socket module 10. The end portion 15A2 projects from the through-hole 17 on a lower surface of the socket module 10. Thus, the end portions 15A1 and 15A2 of the connection member 15 are exposed from the body unit 16, and remaining portions of the connection member 15 are built into the body unit 16. That is, the end portions 15A1 and 15A2 of the connection member 15 become contacts of the socket module 10 for coming in contact with the case 2 of the TSV package 1 and the substrate 21. Also, the connection member 15 functions as the transmission path of the heat as described above.

Moreover, the number of upper flexure portions 15B may be two or more, as illustrated in FIGS. 4A and 4B. Similarly, the number of lower flexure portions 15C also may be two or more. After the left half of the connection member 15 of FIG. 4B is twisted, it is arranged at the position of a dashed line.

The reason why the connection member 15 includes the upper flexure portions 15B and the lower flexure portions 15C as illustrated in FIGS. 4A and 4B is that the part and the amount of bending of the connection member 15 increase and the design flexibility of the connection member 15 increases, compared with the case where the connection member 15 includes a single upper flexure portion 15B and a single lower flexure portion 15C.

Although only the end portions 15A1 and 15A2 project from the through-hole 17 in FIG. 4A, the height of the end portion 15A1 may be identical with that of the upper flexure portions 15B, and the height of the end portion 15A2 may be identical with that of the lower flexure portions 15C. In this case, the end portion 15A1 and the upper flexure portions 15B project from the through-hole 17 on the upper surface of the socket module 10, and become contacts of the socket module 10 for coming in contact with the case 2 of the TSV package 1. The end portion 15A2 and the lower flexure portions 15C project from the through-hole 17 on the lower surface of the socket module 10, and become contacts of the socket module 10 for coming in contact with the substrate 21.

Figure 5:
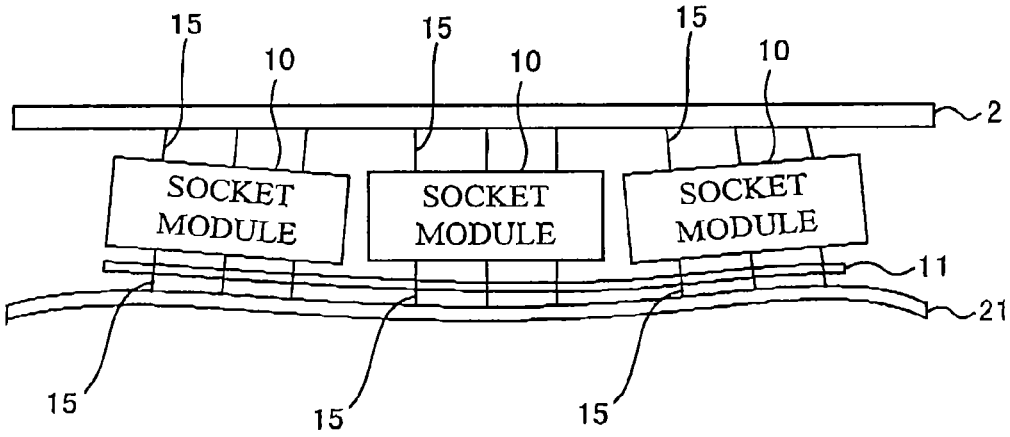
FIG. 5 is a schematic diagram illustrating a state where the socket modules are mounted on the substrate with warpage.

An upper surface and a lower surface of the body unit 16 illustrated in FIG. 3A are an equilateral triangle, and the length of one side of the equilateral triangle is about 2 mm. The centers of the three through-holes 17 provided on the upper surface and the lower surface of the body unit 16 are connected, so that an equilateral triangle is formed. A distance between the centers of the through-holes 17 is about 1 mm. That is, the positions of the respective three contacts exposed from the upper surface and the lower surface of the socket module 10 correspond to the vertices of the equilateral triangle whose length of one side is about 1 mm. Thus, since the socket module 10 is very small, the socket module 10 can be arranged along the warpage of the substrate 21 or the TSV package 1, as illustrated in FIG. 5. Here, FIG. 5 is a schematic diagram illustrating a state where the socket modules 10 are mounted on the substrate 21 with warpage. Although the substrate 21 has the warpage in FIG. 5, the case 2 of the TSV package 1 may have the warpage.

The respective three contacts exposed from the upper surface and the lower surface of the socket module 10 may be arranged at the positions which can support a plane, or so that a triangle can be made when three contacts are coupled. That is, the positions of the three contacts are decided so as not to be arranged on the same straight line.

The number of contact points provided on each of the upper surface and the lower surface of the socket module 10 is not limited to three, but may be three or more. Preferably, three contact points are provided on each of the upper surface and the lower surface of the socket module 10. This is because the three contact points can support the socket module 10 with the most suitable balance. On the contrary, when two contact points are provided on each of the upper surface and the lower surface of the socket module 10, the socket module 10 may incline in any direction. Therefore, three or more contact points need to be provided on each of the upper surface and the lower surface of the socket module 10.

Figure 6A:
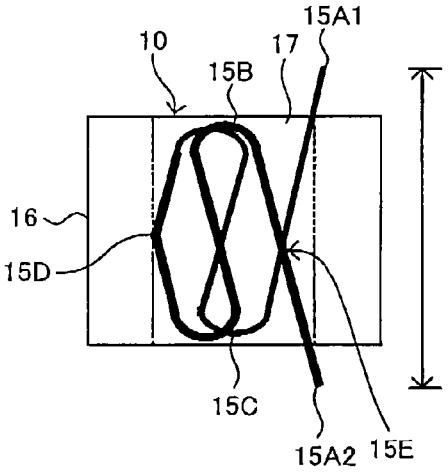
FIG. 6A is a schematic diagram of the socket module before the socket module is sandwiched between a TSV (Through-Silicon Via) package and the substrate.
Figure 6B:
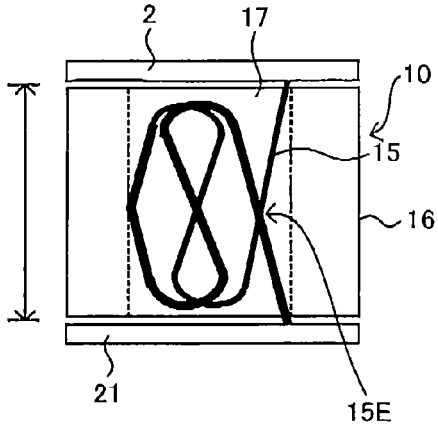
FIG. 6B is a schematic diagram of the socket module after the socket module is sandwiched between the TSV package and the substrate.
Figure 7A:
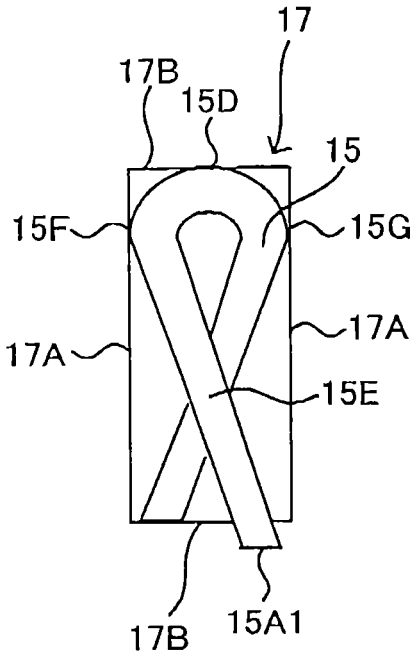
FIG. 7A is a schematic diagram illustrating a state where a through-hole into which the connection member has been inserted is seen from above.
Figure 7B:
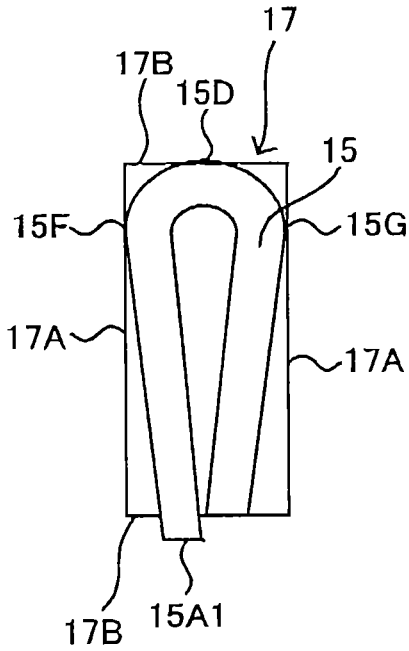
FIG. 7B is a schematic diagram illustrating a variation example of a state where a through-hole into which the connection member has been inserted is seen from above.

FIG. 6A is a schematic diagram of the socket module 10 before the socket module 10 is sandwiched between the TSV (Through-Silicon Via) package 1 and the substrate 21. FIG. 6B is a schematic diagram of the socket module 10 after the socket module 10 is sandwiched between the TSV package 1 and the substrate 21. FIG. 7A is a schematic diagram illustrating a state where the through-hole 17 into which the connection member 15 has been inserted is seen from above. FIG. 7B is a schematic diagram illustrating a variation example of a state where the through-hole 17 into which the connection member 15 has been inserted is seen from above.

Since the connection member 15 has elasticity as described above, the connection member 15 bends as illustrated in FIG. 6B after the socket module 10 is sandwiched between the case 2 of the TSV package 1 and the substrate 21. The length of the connection member 15 in a vertical direction (i.e., a direction from the TSV package 1 to the substrate 21) shortens, compared with FIG. 6A. On the other hand, when the socket module 10 is removed from between the case 2 of the TSV package 1 and the substrates 21, the length of the connection member 15 in the vertical direction extends, compared with FIG. 6B. That is, the end portions 15A1 and 15A2 of the connection member 15 are movable in a projection direction and a retraction direction.

Thus, the length of the connection member 15 in the vertical direction extends or shortens, so that the socket module 10 can absorb the warpage of the substrates 21 or the TSV package 1, as illustrated in FIG. 5. Therefore, the contact reliability of the TSV package 1 to the substrate 21 improves.

It is also desirable that a conductor portion (i.e., a line) extending from the end portion 15A1 to the lower flexure portion 15C comes in contact with a conductor portion (i.e., a line) extending from the end portion 15A2 to the upper flexure portion 15B, as illustrated in FIGS. 6A, 6B and 7A. A contact point between the conductor portions is indicated by reference number 15E. In this case, a signal flows between the case 2 of the TSV package 1 and the substrate 21 via a shortest route, and hence an impedance of the connection member 15 can be reduced.

As illustrated in FIGS. 7A and 7B, the connection member 15 is bent at the middle point 15D so that the left half of the connection member 15 is opposed to the right half of the connection member 15, and a portion 15F on the left side of the connection member 15 and a portion 150 on the right side of the connection member 15 come in contact with inner walls 17A of the through-hole 17. Therefore, the connection member 15 applies a force to the inner walls 17A in a direction pushing the inner walls 17A of the through-hole 17 outward. Thereby, it is possible to prevent the connection member 15 from falling off from the through-hole 17.

In addition, as illustrated in FIGS. 6A, 7A and 7B, the connection member 15 is bent at the middle point 15D so that the left half of the connection member 15 is opposed to the right half of the connection member 15, and neighborhood portions of the end portions 15A1 and 15A2 of the connection member 15 and the middle point 15D come in contact with inner walls 17B of the through-hole 17. Therefore, the connection member 15 applies a force to the inner walls 17B in a direction pushing the inner walls 17B of the through-hole 17 outward. Thereby, it is possible to prevent the connection member 15 from falling of from the through-hole 17.

Figure 8:
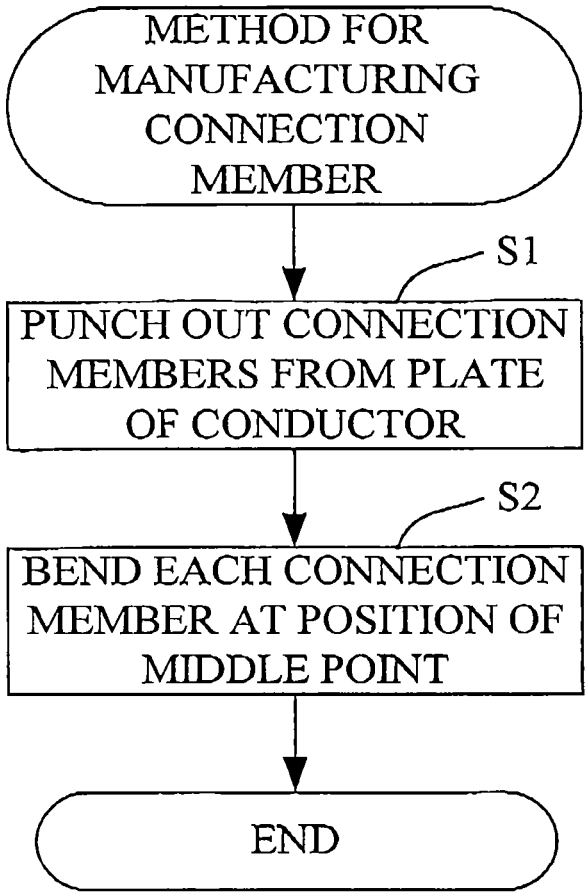
FIG. 8 is a flowchart illustrating a method for manufacturing the connection member.

FIG. 8 is a flowchart illustrating a method for manufacturing the connection member 15.

First, a processing device, not indicated, punches out the connection members 15 as illustrated for example in FIG. 4A from a plate of a conductor (e.g. a copper alloy) by press processing (step S1). The connection members 15 are simultaneously punched out from one plate of the conductor by press processing.

Next, the processing device bends each connection member 15 at a position of the middle point 15D by press processing so that the left half of the connection member 15 is opposed to the right half of the connection member 15 (step S2). Thereby, the connection member 15 has a shape as illustrated in FIG. 6A, for example.

According to the manufacturing method, the connection members with the same shape can be manufactured with high accuracy, compared with the case where the connection member is manufactured by processing a single conductor member into a waveform.

Figure 9A:
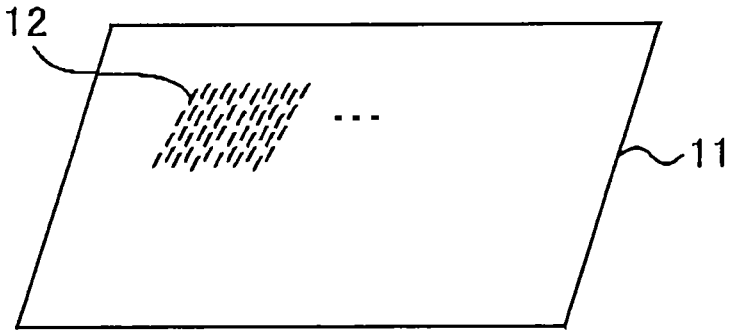
FIGS. 9A and 9B are schematic diagrams illustrating the configuration of a sheet.
Figure 9B:
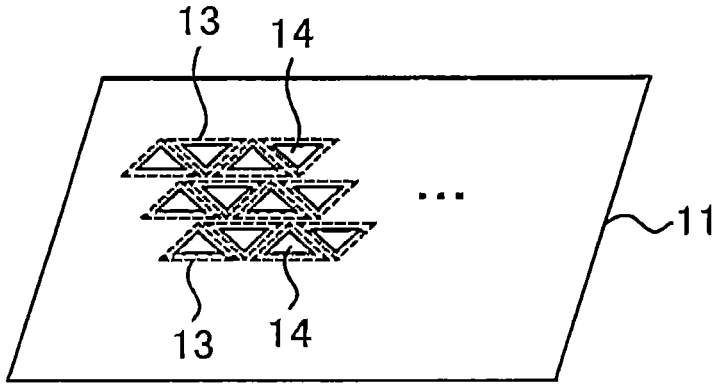

FIGS. 9A and 9B are schematic diagrams illustrating the configuration of the sheet 11.

The plurality of through-holes 12 are formed on the sheet 11, as illustrated in FIG. 9A. The three contact points provided on the lower part of each socket module 10 come in contact with the electrode patterns 22 of the substrates 21 via the through-holes 12. The sheet 11 may be formed with a material having an adhesive force, and may fix the socket modules 10 with the adhesive force. The sheet 11 may fix the socket modules 10 by applying an adhesive on the surface of the sheet 11.

As another example, the sheet 11 may include a plurality of concave portions 13 into which the socket modules 10 are inserted, and a plurality of through-holes 14 provided in the respective concave portions 13, as illustrated in FIG. 9B. The three contact points provided on the lower part of each socket module 10 come in contact with the electrode patterns 22 of the substrates 21 via the through-holes 14. The socket modules 10 may be inserted into and fixed to the concave portions 13, or the socket modules 10 may be fixed to the concave portions 13 by applying an adhesive to the concave portions 13. The sheet 11 may be formed with the material having the adhesive force, and the socket modules 10 may be fixed to the concave portions 13 using the adhesive force.

The socket modules 10 can be coupled with each other by using the sheet 11 illustrated in FIG. 9A or 9B.

Figure 10A:
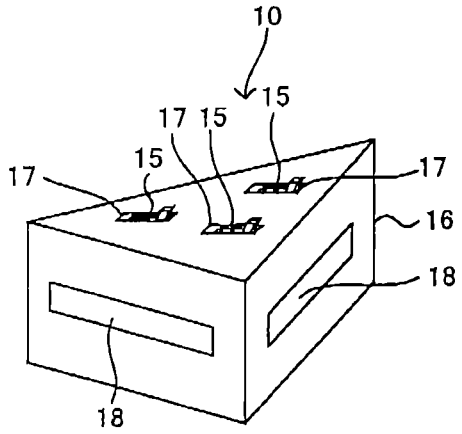
FIGS. 10A and 10B are diagrams illustrating variation examples of the structure of the socket module.
Figure 10B:
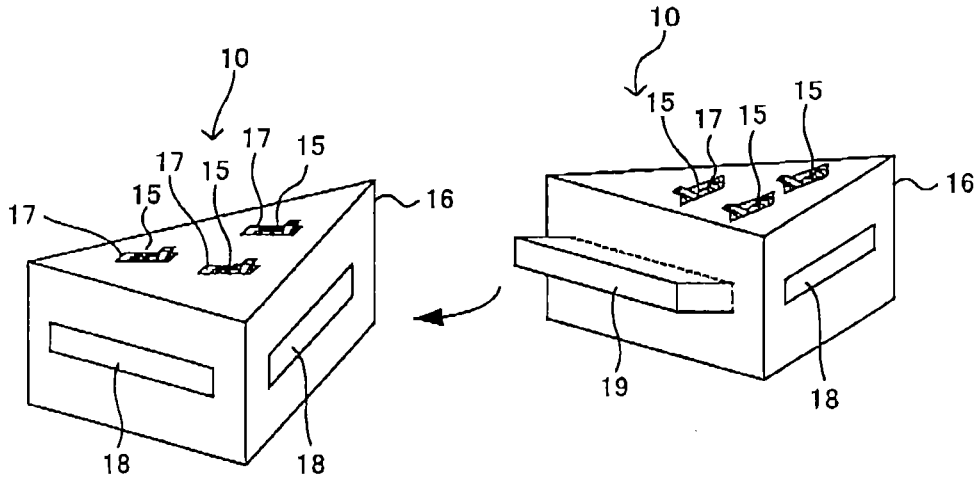

FIGS. 10A and 10B are diagrams illustrating variation examples of the structure of the socket module 10.

A slit 18 exposing the connection member 15 may be formed on at least one side of the socket module 10, as illustrated in FIG. 10A. In this case, since the connection member 15 touches the air, the heat conducted from the TSV package 1 to the connection member 15 is emitted outside through the slit 18. That is, the cooling effect of the connection member 15 can be enhanced.

The slit 18 may be formed on at least one side of the socket module 10, and a projection portion 19 may be formed on at least one of remaining sides of the socket module 10, as illustrated in FIG. 10B. In this case, the slit 18 functions as a vent of the heat and as a plug-in of the projection portion 19. That is, the projection portion 19 of the socket module 10 can be inserted into the slit 18 of another socket module 10.

Thereby, the arrangement of the socket modules 10 is fixed, so that the sheet 11 is unnecessary. That is, it is unnecessary to decide the arrangement of the socket modules 10 using the sheet 11 as illustrated in FIG. 9B.

When the inside diameter of the slit 18 is 1.5 mm×0.5 mm and the depth of the slit 18 is 1 mm, the outside diameter of the projection portion 19 is set as 1.2 mm×0.3 mm and the depth of the projection portion 19 is set as 3 mm, for example. That is, the socket module 10 is configured so that the projection portion 19 can be inserted into the slit 18 and a clearance gap can be formed between a side face of the projection portion 19 and a side face of the slit 18. Since the clearance gap is formed between the side face of the projection portion 19 and the side face of the slit 18, even when the socket modules 10 are coupled with each other, the coupled socket modules 10 can be arranged along the warpage of the substrates 21 or the TSV package 1. That is, when the clearance gap is not formed between the side face of the projection portion 19 and the side face of the slit 18, the coupled socket modules 10 become a single plate. Therefore, the coupled socket modules 10 cannot be arranged along the warpage of the substrates 21 or the TSV package 1.

As described above, according to the present embodiment, when the socket modules 10 are arranged between the TSV package 1 and the substrates 21, each socket module 10 maintains balance with the three contact points and comes in contact with the substrate 21 and the TSV package 1. In addition, each socket module 10 can absorb the warpage of the substrates 21 or the case 2 of the TSV package 1 by the extension or the shortening of the three contact points. Therefore, the contact reliability of the TSV package 1 to the substrate 21 is improved.

The electronic component is not limited to the TSV package, and may be a package including an IC (Integrated Circuit), or a packaged part like a CPU (Central Processing Unit). The configuration of the electronic component and the substrate is not limited to the above-mentioned configuration, and may be a different configuration.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. A connection member to be inserted into a through-hole of a socket module that is electrically connected between an electronic component and a substrate, the connection member comprising:

a first end portion that is connected to the electronic component;

a second end portion that is connected to the substrate;

a plurality of upper flexure portions that correspond to projections of a waveform arranged near the electronic component; and a plurality of lower flexure portions that correspond to projections of the waveform arranged near the substrate;

wherein the connection member is a single conductor member with elasticity and is formed in the shape of the waveform; and the connection member includes a twist at a middle point thereof so that a left half of the connection member overlaps with a right half of the connection member.

2. The connection member according to claim 1, wherein a conductor portion extending from the first end portion to one of the lower flexure portions comes in contact with a conductor portion extending from the second end portion to one of the upper flexure portions by the twist of the connection member.

3. The connection member according to claim 1, wherein a portion on the left side of the connection member and a portion on the right side of the connection member come in contact with the through-hole.

4. The connection member according to claim 1, wherein neighborhood portions of the first and the second end portions of the connection member and the middle point come in contact with the through-hole.

5. A socket module that is arranged and electrically connected between an electronic component and a substrate, comprising:

a body unit that has an upper surface, a lower surface and a side surface; and at least three connection members that are provided in the body unit, project from each of the upper surface and the lower surface, and are movable in a projection direction and a retraction direction;

each of the connection members including:

a first end portion that is connected to the electronic component;

a second end portion that is connected to the substrate;

a plurality of upper flexure portions that correspond to projections of a waveform arranged near the electronic component; and a plurality of lower flexure portions that correspond to projections of the waveform arranged near the substrate;

wherein the connection member is a single conductor member with elasticity and is formed in the shape of the waveform, and the connection member includes a twist at a middle point thereof so that a left half of the connection member overlaps with a right half of the connection member.

6. The socket module according to claim 5, wherein the body unit includes a plurality of side surfaces, and at least one of the side surfaces includes a slit exposing the connection member.

7. The socket module according to claim 6, wherein at least one of the side surfaces includes a projection portion that is inserted into another slit of another socket module, and when the projection portion is inserted into the another slit, a clearance gap is formed between a side surface of the another slit and a side surface of the projection portion.

8. A socket that is arranged and electrically connected between an electronic component and a substrate, the socket comprising:

a plurality of socket modules;

each of the socket modules includes:

a body unit that has an upper surface, a lower surface and a side surface; and at least three connection members that are provided in the body unit, project from each of the upper surface and the lower surface, and are movable in a projection direction and a retraction direction;

each of the connection members including:

a first end portion that is connected to the electronic component;

a second end portion that is connected to the substrate;

a plurality of upper flexure portions that correspond to projections of a waveform arranged near the electronic component; and a plurality of lower flexure portions that correspond to projections of the waveform arranged near the substrate;

wherein the connection member is a single conductor member with elasticity and is formed in the shape of the waveform.

9. The socket according to claim 8, wherein the socket modules are arranged along warpage of at least one of the substrate or the electronic component.

10. The socket according to claim 8, wherein the socket modules are arranged on a flexible sheet and are coupled with each other via the sheet.

11. The socket according to claim 10, wherein the sheet is formed with a material having an adhesive force or includes a plurality of concave portions for fixing the socket modules, respectively.

12. The socket according to claim 10, wherein the socket modules are fixed on the sheet with an adhesive.

13. A method for manufacturing a connection member to be inserted into a through-hole of a socket module that is electrically connected between an electronic component and a substrate, the method comprising:

punching out the connection member from a plate of a conductor, the connection member having elasticity and the shape of a waveform; and twisting the connection member at a middle point thereof so that a left half of the connection member overlaps with a right half of the connection member.

14. The method for manufacturing the connection member according to claim 13, wherein the connection members including:

a first end portion that is connected to the electronic component;

a second end portion that is connected to the substrate;

a plurality of upper flexure portions that correspond to projections of the waveform arranged near the electronic component; and a plurality of lower flexure portions that correspond to projections of the waveform arranged near the substrate.

15. The connection member according to claim 1, wherein a width of the connection member in a longitudinal direction is uniform.

16. The socket module according to claim 5, wherein a width of the connection member in a longitudinal direction is uniform.

17. The socket according to claim 8, wherein a width of the connection member in a longitudinal direction is uniform.

18. The connection member according to claim 1, wherein the shape of the waveform is a curved shape in which concavity and convexity continue, the plurality of upper flexure portions are a plurality of convexities, and the plurality of lower flexure portions are a plurality of concavities.

19. The socket module according to claim 5, wherein the shape of the waveform is a curved shape in which concavity and convexity continue, the plurality of upper flexure portions are a plurality of convexities, and the plurality of lower flexure portions are a plurality of concavities.

20. The socket according to claim 8, wherein the shape of the waveform is a curved shape is which concavity and convexity continue, the plurality of upper flexure portions are a plurality of convexities, and the plurality of lower flexure portions are a plurality of concavities.

* * * * *

UNITED STATES PATENT AND TRADEMARK OFFICE

CERTIFICATE OF CORRECTION

PATENT NO. : 8,911,243 B2
APPLICATION NO. : 13/644165
DATED : December 16, 2014
INVENTOR(S) : Junichi Akama et al.

It is certified that error appears in the above-identified patent and that said Letters Patent is hereby corrected as shown below:

In the Claims
Column 10, Line 29, Claim 20, after “a curved shape” delete “is” and insert -- in --, therefor.

Signed and Sealed this
Fifth Day of May, 2015

Michelle K. Lee

Michelle K. Lee
*Director of the United States Patent and Trademark Office*